US006948678B2

(12) United States Patent
Acciari

(10) Patent No.: US 6,948,678 B2
(45) Date of Patent: Sep. 27, 2005

(54) REWINDING MACHINE WITH AUXILIARY CYLINDERS AND RESPECTIVE WINDING METHOD

(75) Inventor: Giuseppe Acciari, Lucca (IT)

(73) Assignee: A. Celli Nonwovens S.p.A., Lucca (IT)

( * ) Notice: Subject to any disclaimer, the term of this patent is extended or adjusted under 35 U.S.C. 154(b) by 67 days.

(21) Appl. No.: 10/464,533

(22) Filed: Jun. 18, 2003

(65) Prior Publication Data

US 2003/0234315 A1 Dec. 25, 2003

(30) Foreign Application Priority Data

Jun. 25, 2002 (EP) ..... 02425418

(51) Int. Cl.[7] ..... B65H 18/14
(52) U.S. Cl. ..... 242/541.6
(58) Field of Search ..... 242/541.5, 541.6, 242/542, 547

(56) References Cited

U.S. PATENT DOCUMENTS

| | | | | |
|---|---|---|---|---|
| 2,276,980 A | * | 3/1942 | Jacobi | 242/542 |
| 4,180,216 A | | 12/1979 | Dahl et al. | |
| 4,415,128 A | | 11/1983 | Heymanns | |
| 5,632,456 A | | 5/1997 | Krüger | |
| 5,878,975 A | | 3/1999 | Stone et al. | |
| 5,954,291 A | * | 9/1999 | Meinecke et al. | 242/542 |
| 6,149,099 A | * | 11/2000 | Meinecke et al. | 242/542 |

FOREIGN PATENT DOCUMENTS

| | | |
|---|---|---|
| DE | 718 826 | 2/1942 |
| DE | 38 36 367 | 12/1989 |
| EP | 0 640 544 | 3/1995 |
| EP | 0 747 308 | 12/1996 |
| EP | 1 070 675 | 1/2001 |
| GB | 2 268 476 | 1/1994 |

OTHER PUBLICATIONS

Patent Abstracts of Japan, JP 05279926, Oct. 26, 1993, Japan.

* cited by examiner

*Primary Examiner*—William A. Rivera
(74) *Attorney, Agent, or Firm*—McGlew and Tuttle, P.C.

(57) ABSTRACT

The rewinding machine comprises: a first and a second lower winding roller (5, 7) defining a winding cradle for a reel (R) of web (N); a third upper roller (13) having a mobile axis (13) arranged over said first and second lower winding rollers and carried by two mobile slides (11) to allow for the increasing dimension of the reel under formation in said winding cradle. The two slides (11) carry two cylinders (21, 27) whose axes are parallel to the axis (13A) of the third upper roller (13) which are provided with a reciprocal approaching and distancing movement for either approaching or distancing the reel under formation in said cradle.

27 Claims, 5 Drawing Sheets

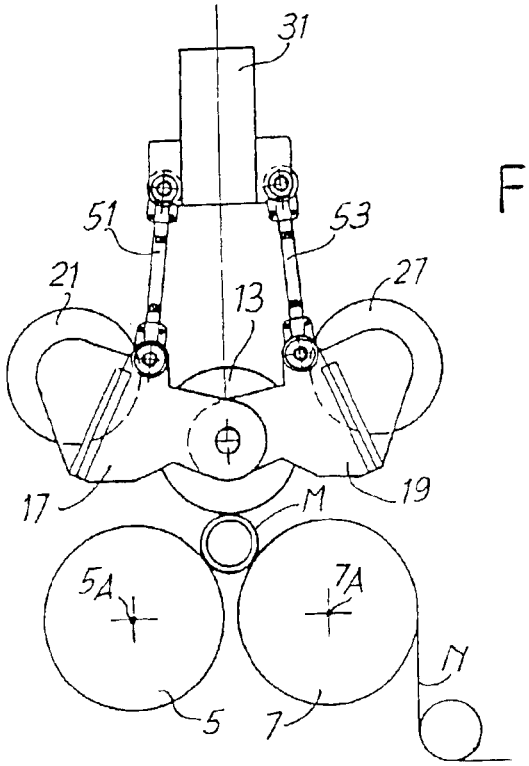
Fig. 4A
Fig. 4B
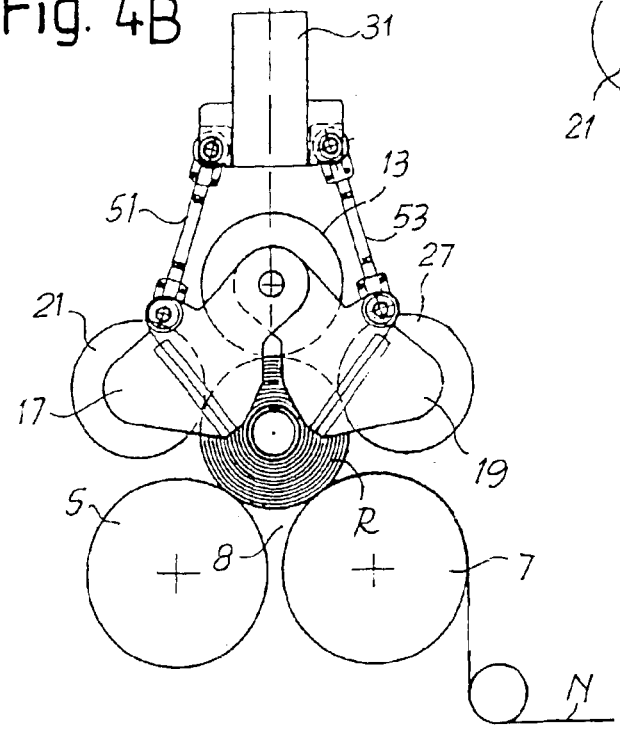
Fig.4C
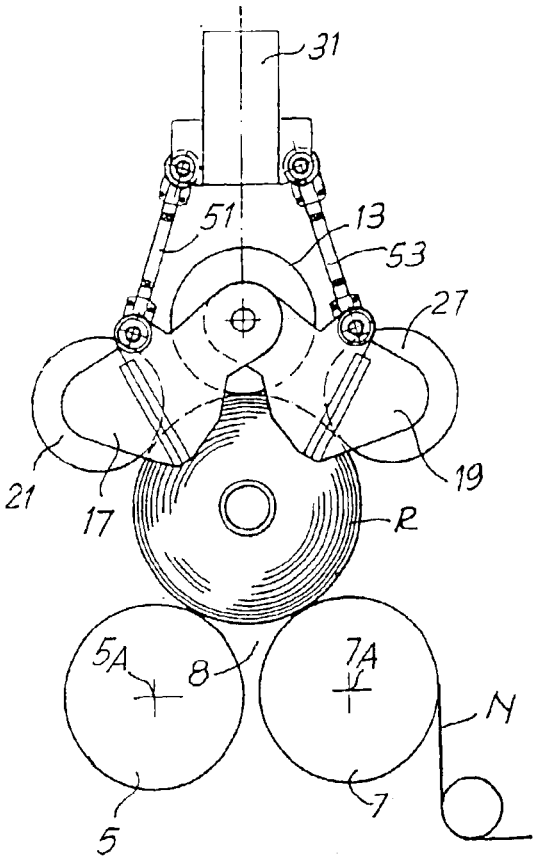

REWINDING MACHINE WITH AUXILIARY CYLINDERS AND RESPECTIVE WINDING METHOD

TECHNICAL FIELD

The invention relates to a peripheral rewinding machine, specifically of the so-called start-stop type, i.e. in which the supply of web to be wound is interrupted or delayed to replace the completed reel with a new winding mandrel. More particularly, the invention relates to a rewinding machine comprising: a first and a second lower winding roller defining a winding cradle for a web material reel under formation; a third upper roller whose axis is mobile arranged over the winding cradle formed by the first and the second lower winding rollers and carried by two mobile slides to allow for the increasing dimension of the reels being formed in the winding cradle.

The invention also relates to a peripheral winding method for reels of web.

STATE OF THE ART

Operations concerning winding or rewinding web are required in the sector of non-woven processing, e.g. in the production of reels of semifinished materials intended for the production of sanitary towels, diapers and the like, and also in the production of paper, e.g. for the production of rolls of toilet paper, kitchen paper or similar, for the production of reels for supplying folding machines for the production of napkins, paper handkerchiefs and similar disposable products.

The web production process is continuous and the web is wound on large diameter parent reels. These reels are later unreeled and the web is rewound on smaller diameters reels or rolls. For some applications, the web is cut longitudinally and continuously and wound on winding cores, which can be made of cardboard, plastic or other suitable material, the cores being fitted and aligned on a winding mandrel. The winding mandrel is expandable, e.g. pneumatically or in any other equivalent way, to secure the winding cores onto it in the required positions. The various tubular cores—which may have identical or different axial lengths—receive corresponding strips of web obtained by longitudinally cutting the web from the parent reel.

The rolls or reels are formed in sequence. When a reel has been completed, it is unloaded from the winding cradle, e.g. formed by two winding rollers arranged side by side, and replaced with a new winding mandrel onto which the winding cores were previously secured.

A rewinding machine of this type is described in EP-A-0747308. Another example of rewinding machine of this type is described in EP-A-1070675. Additional examples of peripheral rewinding machine of the start-stop type, i.e. in which the supply of web is temporarily interrupted to replace the developed reel with another winding mandrel, are described in GB-A-2268476, DE-C-3836367, EP-A-0640544.

These rewinding machines must be capable of winding reels or rolls whose dimensions may be large at considerable high winding speeds. Typically, the web is fed at speeds exceeding 1000 meters per minute, also in the order of 2000 meters per minute.

Controlling the reel may be very difficult at such speeds. Such difficulties are particularly due to the fact that the winding mandrels on which the cores where the web reels will be formed are heavy in weight and tend to deflect by effect of their own weight. Other reported problems refer to eccentricity of the winding cores and winding mandrel inserted inside. Both the eccentricity and the deflection generate strong vibrations at the high winding speed which is typical of these machines. The during winding the reels tend to vibrate in a horizontal direction which is orthogonal to their own axis. The vibrations will be higher when softer material is wound. The vibrations are more relevant when several reels or rolls are formed side by side on a single mandrel. Furthermore, the critical rotation speed of the assembly formed by the mandrel and the reel being formed are relative low and cannot be exceeded due to evident problems of dynamics. Controlling the reel may become very difficult due to these vibrations because of insufficient guiding and hold of the reel being formed, which can also reach very large diameters, in the order of 1–2 meters.

OBJECTS AND SUMMARY OF THE INVENTION

Object of the invention is to make a peripheral rewinding machine, specifically of the start-stop type, which provides a more accurate control of the developing reel by reducing vibrations and consequently allowing production speed increases. Another object of the invention is a winding method providing a more accurate control of the winding conditions.

Essentially, according to the invention, a rewinding machine is provided, comprising: a first and a second lower winding roller defining a winding cradle for a reel of web; a third upper roller whose axis is mobile arranged over said first and second lower winding roller and carried by two mobile slides to allow for the increasing dimension of the reel under formation in said winding cradle. Characteristically, the two slides carry two cylinders whose axes are parallel to the axis of said third upper roller, which are provided with a reciprocal approaching and distancing movement for either approaching or distancing the reel being formed in said cradle. The two cylinders which are arranged by the side of the third winding roller form a more "wrapping" winding cradle with the three winding rollers for the reel or roll being formed. This arrangement consequently controls the vibrations in a more effective and reliable way.

In essence, the reel being formed can be held in contact with five points defined by an equal number of cylinders or rollers during at least one part of the winding cycle. The lower rollers are motor driven while the third upper roller and the two cylinders parallel to the latter can be either driven or idle. The first solution is preferred because the reel can be turned more efficiently.

The two cylinders are advantageously and preferably arranged symmetrically with respect to a vertical plane containing the axis of the third upper roller, despite other arrangements being possible in line of principle. The approaching and distancing movement of the cylinders with respect to the reel under formation can be a translation movement. For example, the cylinders may for this purpose be fitted on mobile saddles or slides. Preferably, however, the cylinders are pivotally supported on an axis which is parallel to the axis of the third winding roller. Each of the two cylinders can be supported on a respective pivoting axis. However, the two cylinders can preferably be mounted on the same axis, which preferably coincides with the rotation axis of the third roller over the cradle defined by the first two winding rollers. This arrangement simplifies transmission of motion to the two cylinders.

In a practical embodiment, the two cylinders are each supported by a pair of pivoting flanks jointed to the two slides which carry the third upper winding roller.

In principle, the two cylinders can rest on the reel under formation during the winding cycle and open only at the end of the winding. However, according to a preferred embodiment of the invention, at least one actuator is provided to control the movement of said two cylinders with respect to the slides and to a central control unit for controlling said movement during the formation of the reel on the basis of at least one control parameter. The movement can be controlled, for example, according to the amount of wound material or, preferably, according to a signal resulting from the stress that the reel under formation applies on the cylinders. For example, load cells can be provided which determine the stress applied by the reel on the two cylinders and accordingly control the opening movement of the two cylinders.

Alternatively, the diameter of the reel under formation can be determined and the position of the two cylinders can be controlled according to said diameter. For this purpose, for example, the position of the third roller and the position of the reel axis can be determined using an encoder or other position transducer. The reel axis can be determined by detecting the position of mating centers (of the type known per se), which engage the axis of the reel under formation. The diameter of the reel or roll under formation is determined on the basis of these two data and the position of the cylinders with respect to the third roller is controlled on the basis of this diameter. The cylinders are opened as the diameter of the reel increases. The force applied by the reel on the cylinders can be measured for greater control, e.g. by means of load cells. An additional opening or closing of the two cylinders can be controlled if the stress is out of a predetermined range.

The invention also relates to a method for forming reels of web comprising the following phases: inserting a winding mandrel in a winding cradle formed by a first and a second lower winding roller; winding an amount of web on said winding mandrel making said winding mandrel turn in said cradle; unloading the formed reel; in which during at least one part of the winding phase said reel is in contact with a third mobile roller arranged over said first and said second lower winding roller, said third roller gradually distancing the first and the second lower winding roller to account for the increasing diameter of the reel. According to the invention, the method is characterized by putting said reel into contact with a pair of cylinders arranged by the sides of the third mobile cylinder for at least a part of the winding phase, the pair of cylinders being mobile with respect to the third roller to follow the increasing diameter of the reel.

This method ensures a better control of the reel during formation thereof, particularly during the intermediate portion of the winding cycle.

Advantageously, the cylinders are gradually pivoted to follow the increasing diameter of the reel, preferably with a pivoting movement on a common axis.

Additional advantageous characteristics and embodiments of the method and of the machine according to the invention are set forth in the annexed claims.

BRIEF DESCRIPTION OF THE DRAWINGS

The invention will be better understood following the description and the enclosed drawings, which show a non-limitative practical embodiment of the invention. In the drawings, where identical numerals indicate identical or corresponding parts.

DETAILED DESCRIPTION OF THE PREFERRED EMBODIMENT OF THE INVENTION

Figure 1:
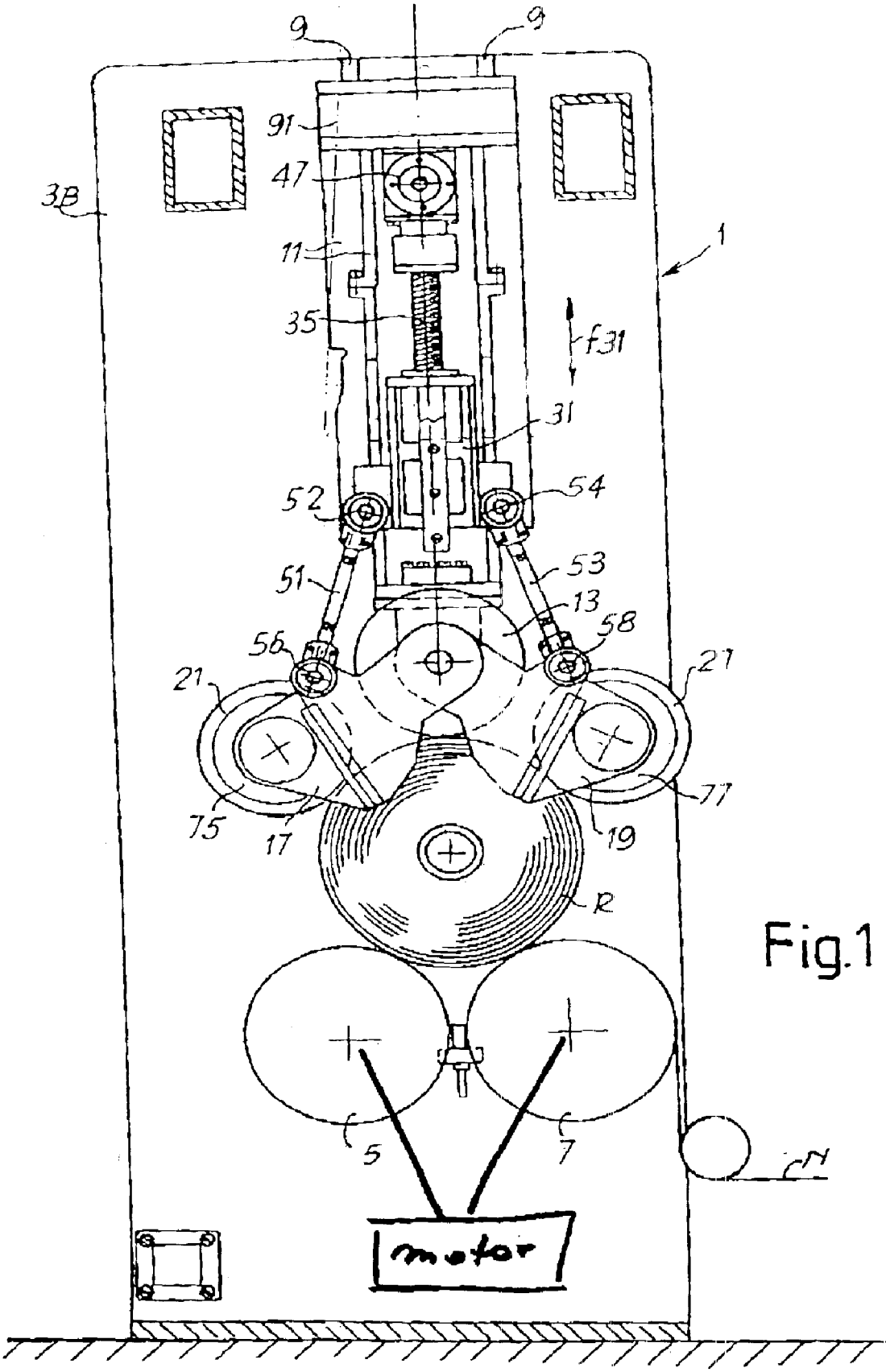
FIG. 1 is a total cross-section view of the machine according to a vertical plane which is orthogonal to the axis of the winding rollers.
Figure 2:
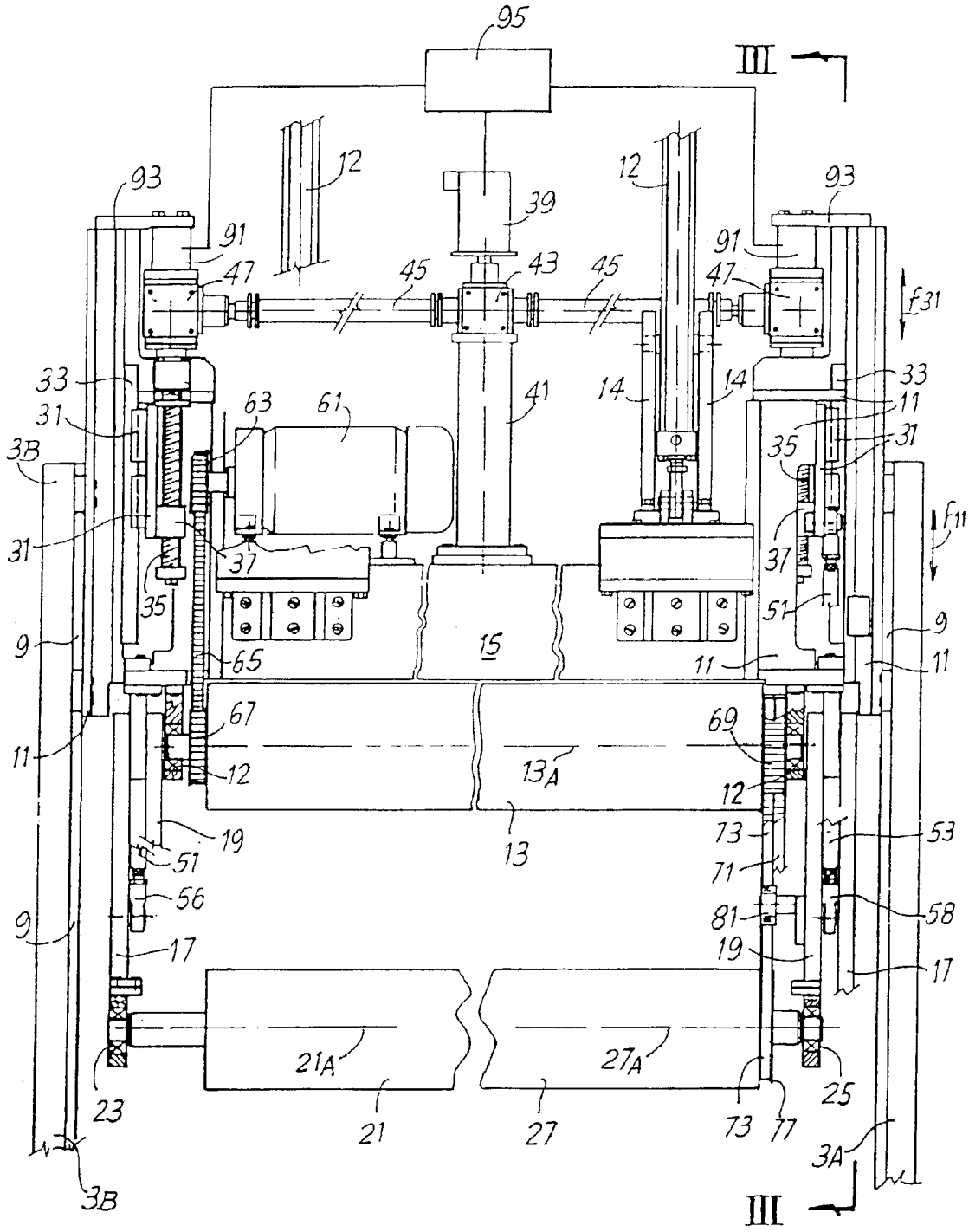
FIG. 2 is a cross-section view according to a plane which is parallel to the axis of the winding rollers showing the assembly formed by the third roller and the two cylinders arranged by the side with the respective transmissions.
Figure 3:
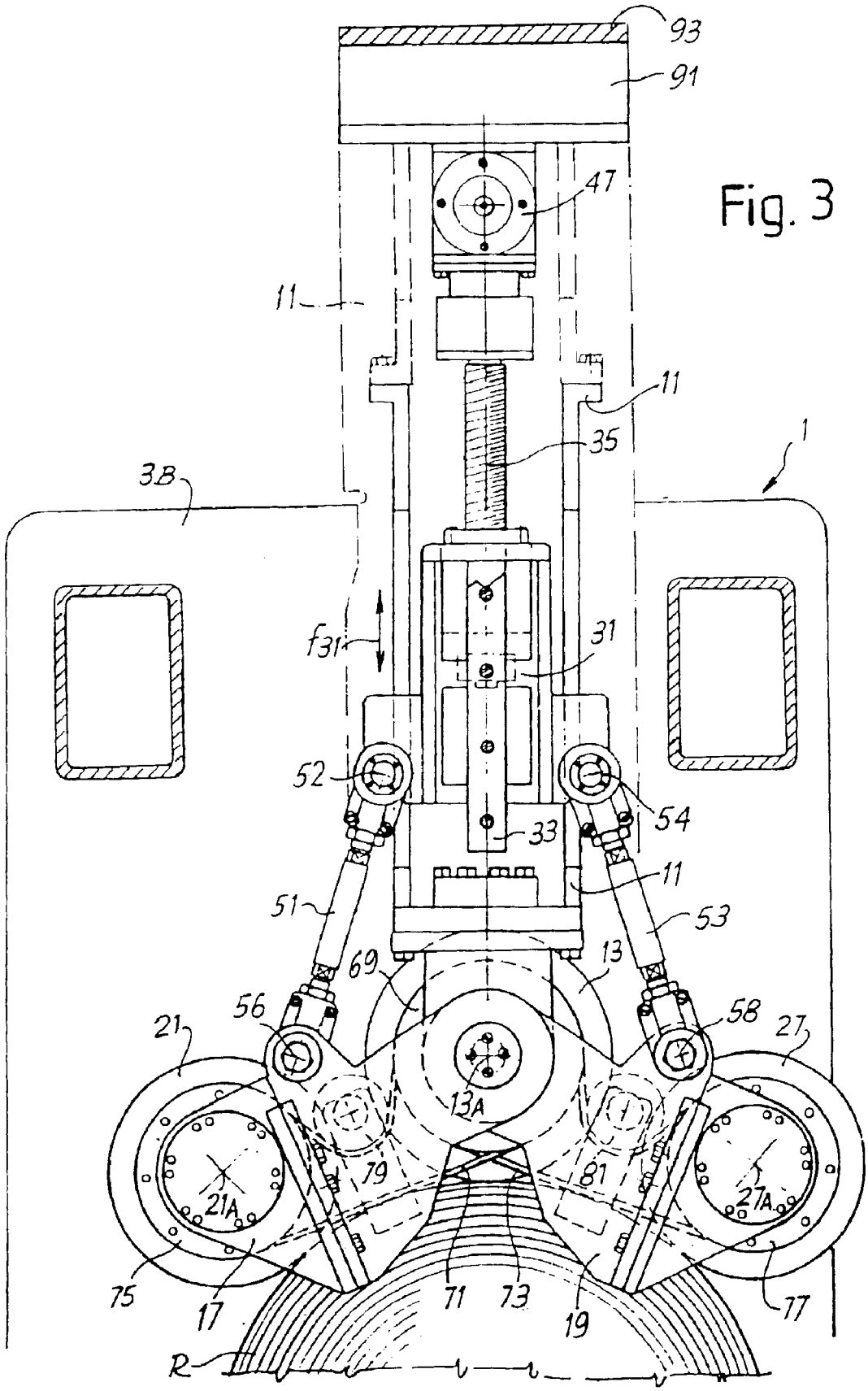
FIG. 3 is a blow-up view of FIG. 1, and FIGS. 4A–4E show five successive phases in the winding cycle of a reel or roll.

The accompanying figures show the salient parts of the rewinding machine except for the components, assemblies and elements which are known per se and are not relevant for understanding the invention. Specifically, the devices for inserting the winding mandrel, unloading the finished reel and for cutting the web at the end of the winding cycle are not shown. The mandrel controlling mating centers, which may be used and which are however known to experts in the field, are also not illustrated.

Reference is made in this description to the development of a reel on the winding mandrel. In actual fact, the reel can be formed by a plurality of single reels arranged side-by-side which simultaneously receive the same length of web, since the winding cycle can be carried out on tubular cores axially aligned on the mandrel by winding strips of web obtained by longitudinally cutting a single incoming web. Consequently, the term "reel" can herein indicate a single reel or a plurality of axially aligned reels formed at the same time in general.

The rewinding machine, generally indicated by reference numeral 1, presents two lateral flanks 3A and 3B which support a first and a second lower winding roller indicated by reference numerals 5 and 7, presenting rotation axes 5A and 7A which are respectively parallel and which define a winding cradle 8 on which a winding mandrel is arranged for forming the web reels. The rollers 5 and 7 are driven by a motor (not shown).

Vertical guides 9 are applied along the flanks 3A and 3B on which respective slides 11 slide. The two slides 11 support, on bearings 12, a third upper roller 13 having an axis 13A and which is arranged parallel and above the lower winding rollers 5 and 7.

The two slides 11 are reciprocally connected by a crossbar 15 which is parallel to the roller 13 for the purposes which will be illustrated below.

Two flanks 17 and 19 pivot on each of the two slides 11 on the same axis 13A of the roller 13. The two flanks 17 support a first cylinder 21 having an axis 21A and parallel to the roller 13, on bearings 23. The two flanks 19 support a second cylinder 27 having an axis 27A and which is again parallel to the upper roller 13 on bearings 25.

The two pairs of flanks 17 and 19 pivot on the axis 13A and are provided with a synchronized and opposite pivoting movement to open and close the cylinders 21 and 27, approaching and distancing them from a vertical plan containing the axis 13A.

A respective slider 31 sliding on a guide 33 which is integral with the slide 11 is provided on each of the slides 11 to control the pivoting movement of the flanks 17, 19 and of the respective cylinders 21 and 27 supported by the flanks. The movement of the slider 31 in the direction of the double arrow f31 on the slide 11 is controlled by a threaded bar 35 which engages a nut screw 37 integral with the slider 31. The rotary movement of the two threaded bars 35 is controlled by a single motor 39 supported by an upright 41 integral with the beam 15 which joins the two slides 11. The movement of the motor 39 is transmitted by a transmission 43 to two cardan shafts or equivalent means 45 and from there to the two jacks 47 associated to the two slides 11. The rotation of the motor 39 consequently controls the movement of the sliders 31 in the direction of the double arrow f31 synchronously on the two slides via the kinematic chain through the mechanism 45, 47, 35.

Two tie-rods 51 and 53 are hinged at 52 and 54 to each of the two sliders 31, whose opposite ends are hinged to the flanks 17 and 19 in points 56 and 58. The hinges 56 and 58 are located by the sides of the vertical plane containing the axis 13A so that the upwards and downwards movement in the direction of the double arrow f31 of the two sliders 31 causes the pivoting movement on the axis 13A of the flanks 17, 19 and consequently of the cylinders 21 and 27.

A motor 61 is supported on the crossbar 15 which, via a pulley 63, transmits movement to a belt 65 turning on an additional pulley 67 fitted on the axis of the roller 13. The motor 61 thus transmits the rotation movement to the third upper roller 13. A second pulley 69, around which two belts 71 and 73 are guided, is fitted on the axis of the third upper roller on the opposite end with respect to the position of the pulley 67. The two belts turn on respective pulleys 75 and 77 fitted on the axes of the cylinders 21 and 27 respectively. The belts 71 and 73 are also turned on respective guide pulleys 79 and 81 carried by the flanks 17 and 19. With this arrangement, the motor 61 turns the cylinders 21 and 27 in addition to the roller 13.

The vertical movement according to the double arrow f11 of the two slides 11 on the guides 9 is controlled by a pair of cylinder-piston actuators 12, fastened by means of brackets 14 to the main flanks 3A, 3B of the machine and whose rods are fastened to the crossbar 15 connecting the two slides 11.

The operation of the rewinding machine described above is clearly illustrated by the sequence of figures from 4A to 4E.

FIG. 4A shows the initial winding phase of the web N on the reel R. During this phase, the diameter of the reel is still small and the reel is in contact with the lower winding rollers 5 and 7 and with the upper winding roller 13. These three rollers are driven and turn at the same peripheral speed to turn the reel under formation. The reel is formed on a winding mandrel M on which tubular cores (made of cardboard, plastic or other material), which will remain inside the reel, were previously inserted and secured. As mentioned above, the reel can consist of a plurality of reels arranged side by side wound simultaneously on tubular cores which are aligned axially and secured onto the winding mandrel M.

Figure 4D:
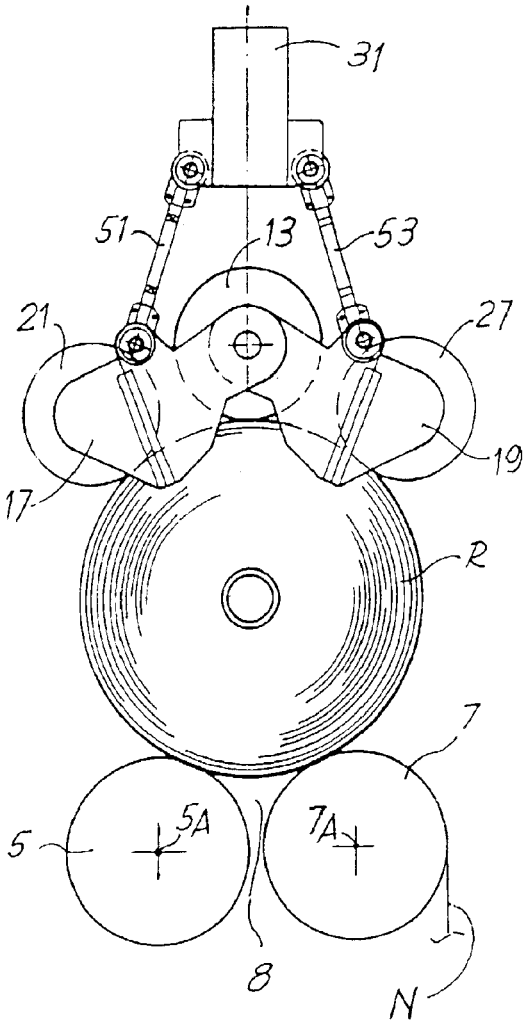
Figure 4E:
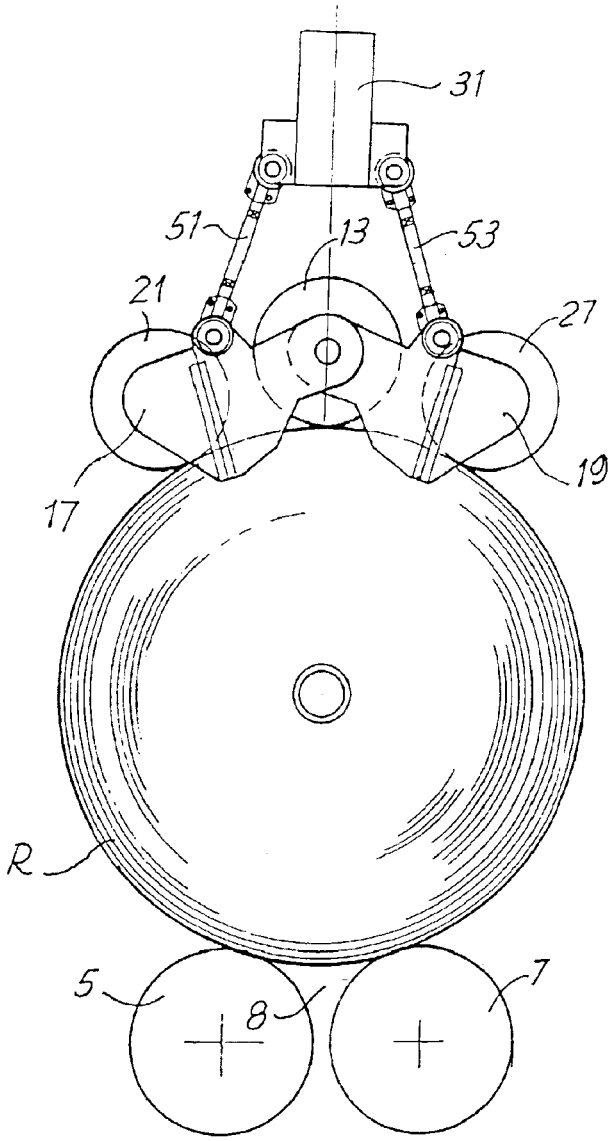

During the initial winding phase, the two auxiliary cylinders 21 and 27 are in a raised position and supported by the respective flanks 17 and 19. Sufficient space is created for putting the cylinders 21 and 27 into contact with the surface of the reel under formation as the diameter of the reel being formed increases, as shown in FIG. 4B. The flanks 17 and 19 are pivoted downwards to take the auxiliary cylinders 21 and 27 into contact with the surface of the reel R under formation. Progressively as the diameter of the reel increases in diameter, as appears in FIGS. 4B and 4C and in FIGS. 4D and 4E (which shows the complete reel), the slides 11 are moved upwards to distance the roller 13 with respect to the rollers 5 and 7. At the same time the auxiliary cylinders 21 and 27 are distanced by a pivoting movement in opposite directions of the flanks 17 and 19. Once the reel R has reached the final diameter, it is unloaded from the winding cradle defined by the winding rollers 5 and 7 in a known way, except for the additional opening movement of the auxiliary cylinders 21 and 27 which are additionally raised to avoid interfering with the unloading of the reel.

The gradual raising movement of the slides 11 and consequently of the roller 13 is controlled in one of the ways which is normally used in machines of this type. The gradual opening movement of the flanks 17, 19—with consequent distancing of the auxiliary cylinders 21 and 27 from the vertical plane containing the axis 13A of the roller 13 to adapt to the increasing diameter of the reel R can be advantageously controlled by means of a load sensor, e.g. a load cell carried by one or both slides 11. The load cell is indicated by reference numeral 91 and is arranged between a head plate 93 of the slide 11 and the angular transmission 47 which transmits the movement to the threaded bar 35. According to this arrangement, the load cell 91 detects a reaction force between the slide 11 (particularly the head plate 93 of the slide) and the slider 31 sliding on the slide. The reaction forces transmitted by the tie-rods 51 (which in certain conditions can be struts when the thrust exerted by the developing reel exceeds the weight force) are relieved on the slider 31.

The reaction force between the reel and the cylinders 21, 27, when the diameter of the reel R increases in a certain angular position of the flanks 17, 19 and consequently of the cylinders 21 and 27, increases. This reaction force is transmitted via the tie-rods 51, 53 on the slider 31 and is consequently read by the load cell 91. The signal generated by the load cell is detected by a control unit (schematically indicated by reference numeral 95) is used to control the motor 39 and make the cylinders 21 and 27 open.

As appears in FIGS. 4A–4E, the reel R under formation is laterally withheld by the auxiliary cylinders 21 and 27 in addition to the winding rollers 5, 7 and 13 during most of the winding cycle. This provides a better control of the reel and also allows the use of winding speeds which are faster than those which can traditionally be reached with rewinding machines of this type.

In the initial phase of the winding cycle, the cylinders 21 and 27 cannot be in contact with the reel under formation due to the lack of space but in this case the reel is sufficiently guided and controlled by the winding rollers 5, 7 and 13. At the end of the winding cycle, the cylinders 21 and 27 can be distanced from the reel in advance with respect to the unloading operation which is proceeded by lifting the winding roller 13. In this way, the presence of the cylinders 21 and 27 does not slow down the reel unloading operation and the operation of exchanging the complete reel for a new winding mandrel.

It is noted that the drawing is provided by the way of a practical example only and that numerous changes can be implemented to the construction and embodiments of the invention herein envisaged without departing from the scope of the present invention. The presence of reference numerals in the annexed claims has the purpose of facilitating comprehension of the claims with reference to the description and the drawing and does not limit the scope of protection represented by the claims.

What is claimed is:

1. A rewinding machine comprising:

a first and a second lower winding roller defining a winding cradle for a reel of web;

a third upper roller having a mobile axis arranged over said first and second lower winding rollers and carried by two mobile sliders to allow for the increasing dimension of the reel under formation in said winding cradle; wherein each of the two slides carry each of two cylinders whose axes are parallel to the axis of said third upper roller and which are provided with at least one o a reciprocal approaching and distancing movement and an oscillatory movement for either approaching or distancing the reel under formation in said cradle wherein said two cylinders pivot on a common axis.

2. Rewinding machine according to claim 1, wherein the common pivoting axis of said two cylinders coincides with the axis of the third upper roller.

3. Rewinding machine according to claim 1, wherein said two cylinders are each supported by a pair of pivoting flanks jointed to the two slides.

4. Rewinding machine according to claim 1, wherein each of said slides presents a slider sliding on the respective slide and in that said two cylinders are secured to said two sliders whose movement causes said cylinders to pivot.

5. Rewinding machine according to claim 4, wherein said sliders are over the axis of the third mobile roller.

6. Rewinding machine according to claim 4, wherein a single actuator controls the movement of both sliders associated to said two slides.

7. Rewinding machine according to claim 6, wherein said actuator is carried by a crossbar connecting said two slides, a transmission being arranged to transmit the movement to said two sliders.

8. Rewinding machine according to claim 7, wherein said single drive is carried by the crossbar connecting said two slides.

9. Rewinding machine according to claim 1, wherein said rewinding machine comprises vertical guides for said slides and actuators which control the movement of said slides on said guides.

10. A rewinding machine comprising:

a first and a second lower winding roller defining a winding cradle for a reel of web;

a third upper roller having a mobile axis arranged over said first and second lower winding rollers and carried by two mobile sliders to allow for the increasing dimension of the reel under formation in said winding cradle; wherein each of the two sliders carry each of two cylinders whose axes are parallel to the axis of said third upper roller and which are provided with a reciprocal approaching and distancing movement for either approaching or distancing the reel under formation in said cradle, wherein said rewinding machine comprises at least one actuator for controlling the movement of said two cylinders with respect to the slides and in that one central unit controls said movement while the diameter of the reel under formation increases according to at least one control parameter.

11. Rewinding machine according to claim 10, wherein said control parameter consist of a signal proportional to the reaction force between said cylinders and the reel under formation.

12. Rewinding machine according to claim 11, wherein said rewinding machine comprises sensors for detecting the force on said cylinders.

13. Rewinding machine according to claim 10, wherein said control parameter is the reel diameter.

14. Rewinding machine according to claim 10, wherein each of said slides presents a slider sliding on the respective slide and in that said two cylinders are secured to said two sliders whose movement causes said cylinders to pivot.

15. Rewinding machine according to claim 14, wherein said sliders are over the axis of the third mobile roller.

16. Rewinding machine according to claim 14, wherein a single actuator controls the movement of both sliders associated to said two slides.

17. Rewinding machine according to claim 16, wherein said actuator is carried by a crossbar connecting said two slides, a transmission being arranged to transmit the movement to said two sliders.

18. Rewinding machine according to claim 10, wherein the rewinding machine comprises vertical guides for said slides and actuators which control the movement of said slides on said guides.

19. A rewinding machine comprising:

a first and a second lower winding roller defining a winding cradle for a reel of web;

a third upper roller having a mobile axis arranged over said first and second lower winding rollers and carried by two mobile sliders to allow for the increasing dimension of the reel under formation in said winding cradle; wherein each of the two slides carry each of two cylinders whose axes are parallel to the axis of said third upper roller and which are provided with a reciprocal approaching and distancing movement for either approaching or distancing the reel under formation in said cradle, wherein said third upper roller and said two cylinders are motor driven.

20. Rewinding machine according to claim 19, wherein a single motor is provided to turn said third roller and said two cylinders.

21. Rewinding machine according to claim 19, wherein the rewinding machine comprises vertical guides for said slides and actuators which control the movement of said slides on said guides.

22. Method for forming reels of web comprising the following phases:

inserting a winding mandrel in a winding cradle formed by a first and a second lower winding roller;

winding an amount of web on said winding mandrel making said winding mandrel turn in said cradle;

unloading the formed reel; and wherein during at least one part of the winding phase said reel is in contact with a third mobile roller arranged over said first and said second lower winding roller; said third roller gradually moving away from the first and the second lower winding roller to account for the increasing diameter of the reel, wherein said reel is put into contact with a pair of cylinders, each of said cylinders arranged by the either side of the third mobile roller, at least for one part of the winding phase, the pair of cylinders being mobile to follow the increasing diameter of the reel, wherein said two cylinders pivot gradually to follow the increasing diameter of the reel on a common axis.

23. Method according to claim 22, wherein a common pivoting axis of said two cylinders coincides with the axis of the third upper roller.

24. Method according to claim 22, further comprising controlling the movement of said two cylinders by at least one actuator with one central unit; and utilizing at least one control parameter to increase the diameter of the reel under formation.

25. Method according to claim 22, further comprising:

inserting the winding mandrel in said cradle;

winding a first amount of web on said winding mandrel holding the third roller in contact with the reel under formation for at least one part of this winding phase;

approaching said two cylinders against the reel under formation and winding at least an additional second amount of web;

distancing the two cylinders from the reel;

unloading the reel from the winding cradle having wound the predetermined amount of web onto it.

26. Method according to claim 25, said cylinders are opened at the end of the winding cycle and distanced from the finished reel and said third roller is raised along with said two cylinders for distancing it from the reel.

27. Method according to claim 22, wherein said first, second and third winding rollers and said two cylinders are motorized.

* * * * *